United States Patent [19]

Pavnica

[11] 4,072,547

[45] Feb. 7, 1978

[54] PAPERHANGING HAND TOOL AND METHOD

[76] Inventor: Joseph F. Pavnica, 311 S. Midland, Joliet, Ill. 60436

[21] Appl. No.: 731,712

[22] Filed: Oct. 12, 1976

[51] Int. Cl.[2] ..... E04F 13/20

[52] U.S. Cl. ..... 156/71; 24/84 R; 156/576

[58] Field of Search ..... 156/71, 576, 574, 575, 156/577; 24/84 R

[56] References Cited

U.S. PATENT DOCUMENTS

| | | | |
|---|---|---|---|
| 882,092 | 3/1908 | Brennan | 156/576 |
| 1,199,269 | 9/1916 | Hammersley | 156/576 |
| 1,318,945 | 10/1919 | Wyborski | 156/576 |
| 2,097,660 | 11/1937 | Gordon | 156/576 |

*Primary Examiner*—Edward G. Whitby

*Attorney, Agent, or Firm*—Ernest S. Kettelson

[57] ABSTRACT

A paperhanging hand tool and method of hanging wallpaper in which a tool comprising an elongated handle and a crosspiece carry a draped over roll of wallpaper cut to wall height with its adhesively coated surfaces facing outwardly, a first length of the roll hanging down from the crosspiece on one side of the tool to face the lower portion of the wall surface to which it is to be applied, the remaining second length of the roll hanging down on the opposite side of the tool with its adhesively coated surface facing the workman who carries the tool by grasping at the lower end of the elongated handle. A clamp is provided near such lower end, having a clamp lever biased toward the clamped shut position and positioned for manipulation of the clamp lever by the thumb of the workman's hand which grasps the tool at its lower end.

8 Claims, 4 Drawing Figures

PAPERHANGING HAND TOOL AND METHOD

BACKGROUND OF THE INVENTION

This invention relates to the field of tools for hanging wallpaper and a method of applying wallpaper to walls.

An age old problem in the wallpaper hanging art is how to hold a roll of wallpaper in orderly fashion after one surface has been coated with adhesive, or after a pre-coated adhesive surface has been exposed, to then carry it in likewise orderly fashion to the place on the wall to which it is to be applied, then to hold it in place while adjacent portions are matched with a previously applied roll, and to finally maintain such position exactly while the roll is applied to the wall. In the interest of economy and efficiency it is desirable to enable one workman to do all of these things alone.

Many tools, machines and devices have been proposed to do one or more of these things in the wallpaper hanging art. Most of them are complicated, heavy and cumbersome, as well as expensive. U.S. Pat. No. 2,511,040 to Arthur M. Boone illustrates one such device which includes a collapsible boom having casters on its lower end to roll on the floor. A clamping device is provided at the upper end, at each side of the roller extending across the top. The end of a wallpaper roll is clamped to the top roller, the boom is extended the length of the wall with the entire length of the paper hanging down on one side of the device. It is then rolled to the desired location to position the wallpaper, and the strip of paper is then affixed to the wall or ceiling in the usual manner according to that patent. The device is not used in any way itself to apply the paper to the wall.

U.S. Pat. No. 2,097,660 to Arthur E. Gordon illustrates another prior art paperhanging machine which is complex as well as relatively expensive. It includes a table pivotally mounted at the end of a pole, and a clamp on the table assembly to grasp the end of a wallpaper roll. The device is not constructed in such a way to enable draping the wallpaper over a crossarm and then to use the tool to apply the paper to the wall as the present invention is able to do. As stated in that patent, after the strip of paper has been attached to the ceiling (or wall) by means of the machine, the operator then takes a long handled paper hanger's brush and brushes the paper so as to assure that every portion thereof will be brought into proper contact with the ceiling (or wall).

U.S. Pat. No. 2,548,393 to Lyman C. Reibe illustrates another wallpaper hanging tool known in the prior art. This tool is also complex and would be expensive to make. It grasps a roll of paper at each opposite end and stretches it taut by means of angled brace member pivotally connected.

U.S. Pat. No. 2,521,501 Clifton L. Brockmann illustrates a ceiling paper hanger in the form of a rectangular frame. Its primary object is to apply paper to a ceiling in a straight line. One end of the paper is secured to one end of the frame by bent over pins or nails. That end of the paper is applied to the wall first, the pins then pulled out, and a brush on the other end is used to press the rest of the paper roll in place, much the same as any other known paper hanging brush.

U.S. Pat. No. 2,594,835 to Archie L. Wornstaff discloses a clamping device at one end of two resilient limbs, and a sharp prong at the other end which is stuck into the wall while the clamping end holds one end of a roll of paper jammed into a corner. The object is to hold one end of the paper while a workman has both hands free to apply the wallpaper to the wall.

U.S. Pat. No. 1,626,020 to Ernest R. Burkey and U.S. Pat. No. 1,058,185 to James Krondak illustrate additional known devices available in the prior art for assisting in various phases of hanging wallpaper.

None of the known prior art devices disclose a tool for draping the wallpaper roll over a crossarm at a mid-region of the roll, having the portion of the roll which is to be applied to the lower part of the wall draped on one side of the tool and the portion of the roll to be applied to the upper part of the wall draped on the other side of the tool, and having a clamp adjacent to the hand grasp on the handle whereby a workman can lift, carry, position, align, apply and smooth a roll of paper with only one hand by use of this tool. The machines, tools and devices known in the prior art include projecting members of various kinds on one side or the other which would catch and tear a roll of paper draped over both sides of the device, particularly when soaked with the water base pastes commonly used. The tool in accordance with the present invention is smooth on both sides which face the draped over lengths of paper, and the crossarm and elongated handle are coplanar on both sides to eliminate the possibility of catching and tearing the paper as it is fed out over the crossarm when being applied.

SUMMARY OF THE INVENTION

It is an object of the invention to provide a wallpaper hanging hand tool having a crossarm and elongated handle, in which the elongated handle is dimensioned to carry a roll of wallpaper draped over the crossarm with one fractional part of the roll hanging down on one side of the elongated handle and the other fractional part of the roll hanging down on the other side of the handle.

It is an object of the invention to provide a wallpaper hanging tool having a crossarm and elongated handle, with a clamp for securing one end of a draped over roll of wallpaper mounted on said handle adjacent the hand grasp end thereof.

It is an object of the invention to provide a wallpaper hanging tool having a crossarm and an elongated handle, it which both sides thereof which face respective lengths of a draped over roll of wallpaper are coplanar.

It is an object of the invention to provide a wallpaper hanging tool which enables a workman to grasp, lift, carry, position, align, apply and smooth a roll of wallpaper with only one hand by using such tool.

It is an object of the invention to provide a method for hanging wallpaper by a workman using one hand, including the steps of grasping, lifting, carrying, positioning, aligning, applying and smoothing.

DESCRIPTION OF A PREFERRED EMBODIMENT

Figure 1:
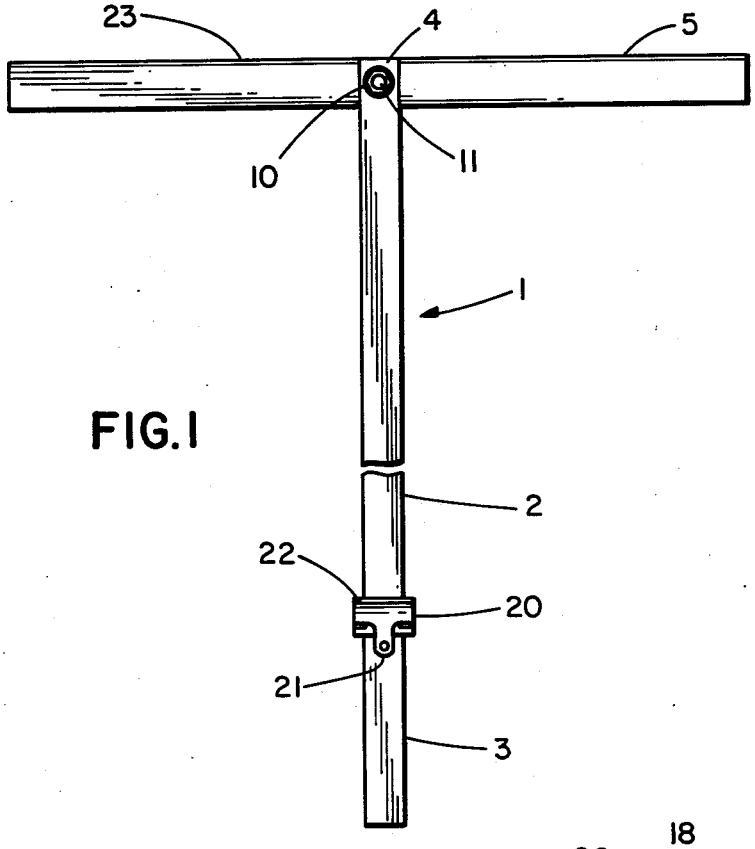
FIG. 1 is a plan view of a wallpaper hanging tool in accordance with this invention.
Figure 2:
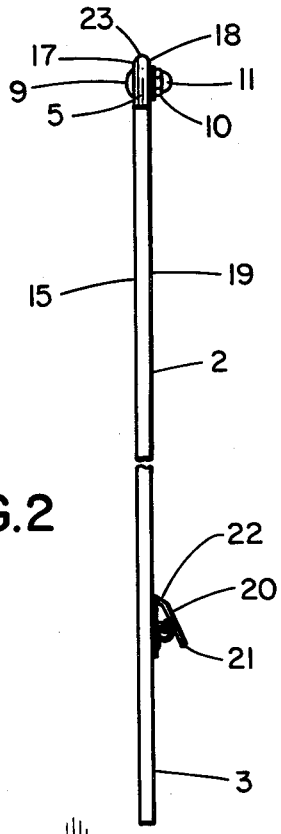
FIG. 2 is a side elevation view of the tool in FIG. 1.
Figure 3:
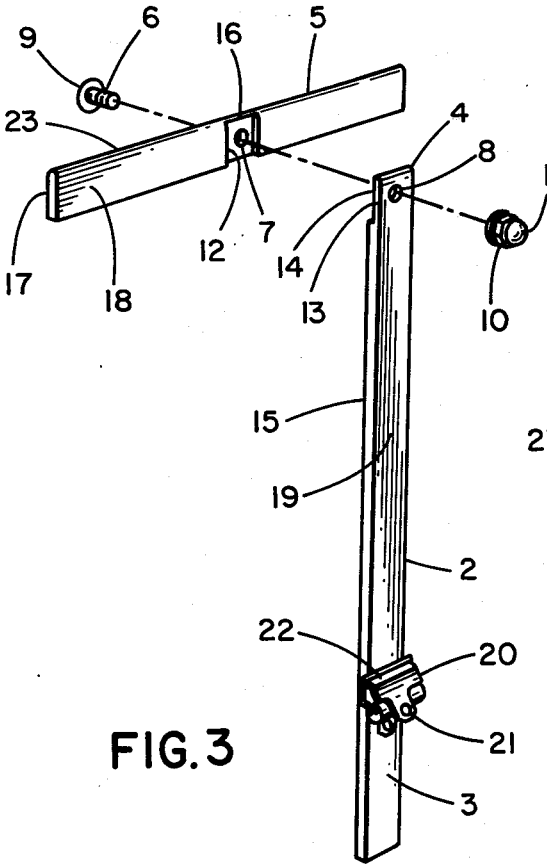
FIG. 3 is an exploded perspective view of the wallpaper hanging tool in accordance with this invention.
Figure 4:
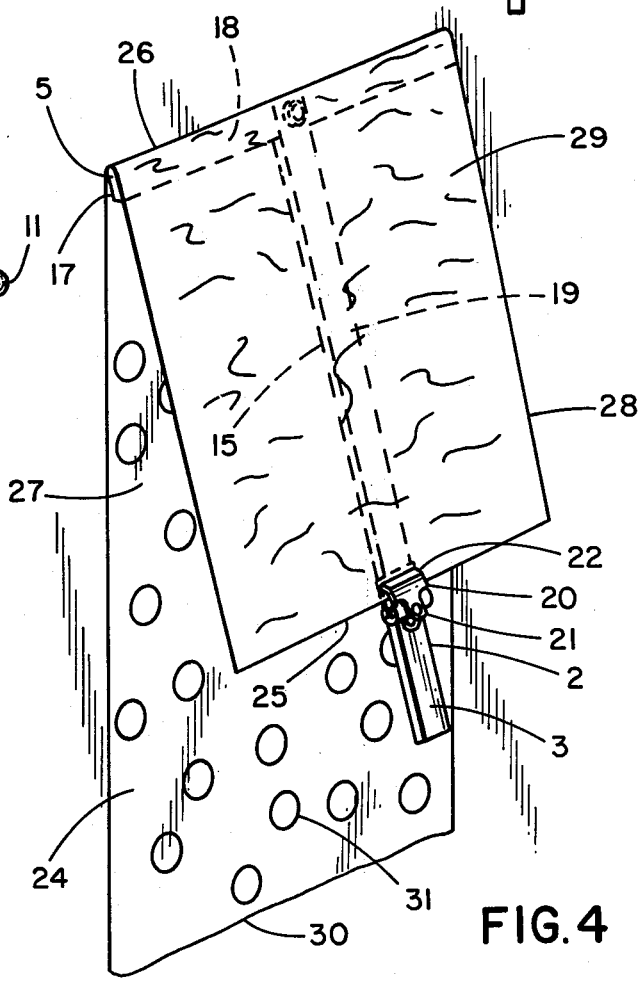
FIG. 4 is a perspective view of the hand tool in FIG 1 shown with a roll of wallpaper draped thereon.

A hand tool 1 for hanging wallpaper in accordance with this invention includes an elongated handle 2 having a hand grasp end portion 3. The length of the hand grasp end portion 3 is approximatley the width of a workman's hand. The opposite end 4 of the elongated handle 2 is secured to a crossarm member 5 by means of a bolt 6 through aperture 7 in crossarm 5 and aperture 8 in the handle 2. The bolt 6 includes a rounded head 9 at one end and a capped nut 10 threaded on the other end. The capped nut 10 includes an outwardly projecting rounded surface 11, the threaded end of bolt 6 being enclosed within the capped nut 10 when the nut is tightened thereon. The capped nut 10 having such rounded surface 11 protects the draped over length of a roll of wallpaper when being carried on such tool and when being applied to a wall. The rounded head 9 of the bolt 6 likewise presents a smooth surface to the adjacent length of draped over wallpaper when carried on such tool, when being applied to the wall and when the tool is subsequently used to smooth and press the entire length of paper against the wall surface.

The crossarm member 5 includes a recess 12 having a width slightly larger than the width of elongated handle 2 to receive said handle snugly therein. The end 4 of handle 2 includes a corresponding projecting cut-away portion 13, including a recessed planar surface 14 inset from the side 15 of handle 2, lying in a plane parallel to that of the surface of side 15. The recessed planar surface 14 extends from the end 4 of handle 2 inwardly for a distance substantially equal to the width of crossarm member 5.

The depth of the recess 12 of crossarm member 5 is substantially equal to the thickness of the projecting cut-away portion 13 at the end of handle 2. The depth which recessed planar surface 14 of handle 2 is inset from the surface of side 15 of handle 2 is substantially equal to the thickness of the bridging portion 16 of crossarm member 5 across the back of recess 12 of the crossarm member 5.

The projecting cut-away portion of elongated handle 2 seats in the recess 12 of the crossarm member 5, and the surface of side 15 of handle 2 is then coplanar with the surface of side 17 of crossarm member 5. Also, the surface of the opposite side 18 of crossarm member 5 is coplanar with the surface of opposite side 19 of the elongated handle 2, when the projecting cut-away portion 13 of the handle is seated in the recess 12 of the crossarm. When so seated, the aperture 7 of the crossarm member 5 is in registration with aperture 8 of the elongated handle 2. The bolt 6 is placed through such apertures, and the capped nut 10 is threaded thereon to secure the crossarm member 5 to the elongated handle 2.

A clamp member 20 is mounted on side 19 of elongated handle 2, at a point thereon spaced inwardly of hand grasp end portion 3 a distance substantially equal to the width of a workman's hand so he may depress the clamp lever 21 with his thumb to open the receiving jaw members 22 to initially receive the end of a roll of wallpaper therein and to eventually release such end of the roll when applying it to a wall. The clamp member 20 is spring biased toward a jaw closed or clamping position.

The crossarm member 5 includes a top edge 23 which is rounded to enable it to slide with a minimum of friction over the surface of a roll of wallpaper when applying it to a wall, and when pressing thereagainst to smooth the paper and urge it more firmly into contact with the wall.

In operation, a workman grasps the elongated handle 2 at the hand grasp end 3 with one hand, and slides the crossarm member 5, rounded edge 23 first, under a prepared roll of wallpaper 24 cut to wall height and lying flat on a table or other work surface with its adhesive surface face up. The crossarm member 5 is moved inwardly and under the roll of wallpaper 24 about one-fourth to one-half its length and until its end 25, which will be its upper end when applied to the wall, can be grasped between the jaws 22 of clamp member 20. The workman depresses clamp lever 21 with his thumb and inserts the end 25 of the roll of wallpaper 24 between the jaws 22 which are then released to clamp the end 25 of the wallpaper roll 24 therein.

The wallpaper roll is then lifted from the work surface with the crossarm member 5 across an intermediate portion 26 of the wallpaper roll 24, having one fractional length 27 of the wallpaper roll (which will be its lower fractional length when applied to the wall) draped downwardly adjacent side 15 of the handle 2 and side 17 of crossarm member 5, and the other fractional length 28 of the wallpaper roll (which will be its upper fractional length when applied to the wall) draped downwardly adjacent the opposite side 18 of crossarm member 5 and opposite side 19 of elongated handle 2. The adhesive surface 29 of the wallpaper roll 24 faces outwardly on both of the draped over sides.

The workman using his one hand positions the portion of the roll of wallpaper 24 which is draped over the crossarm member 5 adjacent a roll of wallpaper previously applied to the wall and against the wall at a height whereby the bottom end 30 of the lower fractional length 27 of the wallpaper roll 24 reaches the bottom edge of the wall. The workman aligns the roll being applied so its pattern matches that of the adjacent one previously applied to the wall, and then presses the crossarm member 5 firmly against the wall with the elongated handle 2 at an acute angle, preferably of about 45 degrees or less, to the wall.

The workman then depresses the clamp lever 21 with his thumb to release the end 25 of the wallpaper roll 24 from the clamp member 20. At the same time he begins to move the tool and crossarm 5 upwardly, keeping the crossarm 5 pressed against the wall with its rounded edge 23 sliding over the patterned surface 31 of the wallpaper roll 24 as the crossarm 5 is moved upwardly along the wall toward the ceiling. As it is moved upwardly, the upper fractional length 28 of wallpaper roll 24 is fed out over the crossarm member 5 on to the wall surface until its end 25 is pressed in place on the wall. The elongated handle 2 is of sufficient length to extend from a mid-region of wallpaper roll 24 to beyond the end 25 thereof, and to enable a workman to extend the crossarm member 5 up to the junction of the ceiling and the wall being papered.

When the upper end 25 of wallpaper roll 24 is pressed in place, the workman moves the crossarm member 5 downwardly along the wallpaper roll pressing the rounded edge 23 of the crossarm member firmly thereagainst, until it reaches the bottom edge 30 of wallpaper roll 24. The lower fractional length 27 of wallpaper roll 24 is thus applied to the wall by the use of such tool during the downward sweep of the crossarm member 5, after the upper fractional length 28 has been applied during the initial sweep of the crossarm 5 upwardly.

The workman may then use the tool to smooth the applied roll, by pressing the rounded edge 23 of crossarm member 5 against the surface of the applied roll as it is moved up and down the length of the applied roll.

The length of the elongated handle 2 with reference to a roll of wallpaper cut to wall height, and for which the tool 1 is to be used, is preferably between one-fourth and one-half the length of the wallpaper roll cut to wall height, plus the length of the hand grasp portion 3. Thus for a wall 8 feet high, the length of the handle 2 would preferably be between 2 feet and 4 feet, plus the length of the hand grasp portion 3. The length of hand grasp portion 3 is substantially equal to the width of a workman's hand. Such length of handle 2 makes it possible to drape a roll of wallpaper 24 cut to wall height over the crossarm member 5 with between one-fourth and one-half of the wallpaper roll 24 hanging down on side 19 of handle 2 and side 18 of crossarm member 5 about 2 to 4 feet, and the other one-half to three-fourths hanging down on side 15 of handle 2 and side of 17 of cross arm member 5 about 4 to 6 feet. When such tool 1 is held extended by a workman's arm, both fractional lengths of the draped over wallpaper roll are able to clear the floor when being carried to the wall to which it is being applied.

I claim:

1. A hand tool for hanging wallpaper, comprising an elongated handle of a preselected length, said handle including hand grasp means extending inwardly from a first end thereof to enable a workman to hold said handle with one hand, clamp means adjacent said hand grasp means to clamp an edge of a roll of wallpaper therein, a crosspiece affixed to the opposite second end of said elongated handle, including a roll of wallpaper draped over said crosspiece having a first fractional length extending along a first side from said crosspiece to said clamp means, the remaining fractional length of said draped over roll of wallpaper extending downwardly from said crosspiece on said opposite second side of said handle and crosspiece, wherein said first fractional length of said roll of wallpaper is any fraction between one-third and one-half of the total length of said roll of wallpaper cut to wall height.

2. A hand tool for hanging wallpaper, comprising an elongated handle of a preselected length, said handle including hand grasp means extending inwardly from a first end thereof to enable a workman to hold said handle with one hand, clamp means adjacent said hand grasp means to clamp an edge of a roll of wallpaper therein, a crosspiece affixed to the opposite second end of said elongated handle, including a roll of wallpaper draped over said crosspiece having a first fractional length extending along a first side from said crosspiece to said clamp means, the remaining fractional length of said draped over roll of wallpaper extending downwardly from said crosspeice on said opposite second side of said handle and crosspiece, wherein said first fractional length of said roll of wallpaper is any fraction between one-fourth and one-half of the total length of said roll of wallpaper cut to wall height.

3. A hand tool for hanging wallpaper, comprising an elongated handle of a preselected length, said handle including hand grasp means extending inwardly from a first end thereof to enable a workman to hold said handle with one hand, clamp means adjacent said hand grasp means to clamp an edge of a roll of wallpaper therein, and a crosspiece affixed to the opposite second end of said elongated handle, including a notch in a notched portion of said elongated handle to receive a mid-portion of said crosspiece, a corresponding recess in said crosspiece at said mid-portion to cooperatively receive said notched portion of said elongated handle, the respective depths of said notch and recess being such that said first and second sides respectively of said elongated handle and crosspiece are coplanar when said notched portion of said elongated handle is received in said recess of said crosspiece.

4. A hand tool for hanging wallpaper as set forth in claim 3, including a bolt extending through said crosspiece and said elongated handle to hold them assembled together, said bolt including a head having a rounded surface at one end thereof, a cap not threaded on the opposite end of said bolt to hold said crosspiece and elongated handle in assembled relationship, said cap nut having a rounded surface projecting outwardly thereof.

5. A hand tool for hanging wallpaper, comprising en elongated handle of preselected length, said handle including hand grasp means extending inwardly from a first end thereof to enable a workman to hold said hand grasp means to clamp an edge of a roll of wallpaper therein, and a crosspiece affixed to the opposite second end of said elongated handle, including a roll of wallpaper draped over said crosspiece having a first fractional length extending along said first side from said crosspiece to said clamp means, the remaining fractional length of said draped over roll of wallpaper extending downwardly from said crosspiece on said opposite second side of said handle and crosspiece, wherein said preselected length of said handle is equal to the said first fractional length of said roll of wallpaper draped over said crosspiece plus the distance said hand grasp means extends inwardly from said first end of said enlongated handle.

6. A hand tool for hanging wallpaper as set forth in claim 8, wherein said crosspiece includes an edge thereof facing in a direction opposite to that in which said elongated handle extends from said crosspiece, said edge of said crosspiece being rounded.

7. A method of hanging wallpaper including the steps of selecting an elongated handle, affixing a crosspiece to one end thereof, grasping said handle in one hand at the opposite end thereof, laying a roll of wallpaper flat on a work surface with its adhesively coated surface facing upwardly, sliding said crosspiece under said roll of wallpaper to a mid-region thereof from one end thereof until said one end of said wallpaper lies adjacent said hand which grasps said handle, clamping said one end of said wallpaper, lifting said handle and crosspiece to raise said roll of wallpaper from said work surface and thus draping said roll of wallpaper over said crosspiece, carrying said draped over roll of wallpaper to a wall to be papered, positioning said crosspiece at a height from the bottom edge of said wall to be papered so the first fractional length of wallpaper hanging from said crosspiece on the side thereof facing said wall reaches said bottom edge, pressing said crosspiece having said roll of paper draped there-over against said wall, unclamping said one end of said wallpaper, moving said crosspiece upwardly along said wall while pressing said crosspiece against said wall to feed out a second and remaining fractional length of said roll of wallpaper over said crosspiece and apply said second fractional length to the upper fractional portion of said wall, moving said crosspiece downwardly and pressing it against said first fractional length throughout to apply said first fractional length to the lower remaining fractional portion of said wall.

8. A method of hanging wallpaper as set forth in claim 7, wherein the step of clamping said one end of said wallpaper includes the steps of affixing a clamp member having a clamp lever to said handle at a point next to said hand which grasps said handle at one end thereof, pressing said clamp lever with the thumb of the hand which grasps said handle to open said clamp member to receive said one end of said wallpaper roll in said clamp member, and releasing said clamp lever to clamp said end of said roll of wallpaper in said clamp member.

* * * * *